United States Patent [19]

Shebuski

[11] Patent Number: 4,566,520

[45] Date of Patent: Jan. 28, 1986

[54] METHOD AND APPARATUS FOR REMOVING A CASTING FROM A SANDBOX

[75] Inventor: Robert C. Shebuski, Hubertus, Wis.

[73] Assignee: Outboard Marine Corporation, Waukegan, Ill.

[21] Appl. No.: 621,204

[22] Filed: Jun. 15, 1984

[51] Int. Cl.[4] ..... B22D 29/00

[52] U.S. Cl. ..... 164/131; 164/404

[58] Field of Search ..... 164/401, 402, 404, 131, 164/132, 344, 345, 346, 224, 409, 44, 213; 264/334; 425/422, 424, 436 R, 435, 444

[56] References Cited

U.S. PATENT DOCUMENTS 1,758,883 5/1930 Camerota ..... 164/404

*Primary Examiner*—Kuang Y. Lin

*Assistant Examiner*—Samuel M. Heinrich

*Attorney, Agent, or Firm*—Michael, Best & Friedrich

[57] ABSTRACT

A method for removing a casting from a sandbox, the method comprising the steps of rotating a sandbox including therein a casting embedded in sand so as to dump the sand from the sandbox, holding the casting while the sand is being dumped so as to maintain a substantially stationary relationship between the casting and the sandbox, and removing the casting from the sandbox after a portion of the sand has been dumped.

9 Claims, 7 Drawing Figures

METHOD AND APPARATUS FOR REMOVING A CASTING FROM A SANDBOX

BACKGROUND OF THE INVENTION

The invention relates to methods and appartus for removing a casting or a casting cluster from a sandbox.

The primary problem encountered while removing a casting from a sandbox is that, because the casting is relatively soft and easily distorted, the casting cannot simply be pulled out of the sand. This could probably result in distortion of the casting.

Known methods for removing a casting from a sandbox include (a) grasping the sprue of the casting and then fluidizing the sand to permit extraction of the casting, and (b) dumping the sand and the casting onto a screen. Both methods have several disadvantages. The fluidizing method requires extra fluidizing equipment and often causes sand to be distributed about the working area. It also requires that the casting have a larger sprue in order to withstand the extraction forces. The dumping method results in the loss of orientation of the casting. It requires a manually operated mechanical device in order to remove the casting for further processing. This requires more time and labor.

Attention is directed to Ettore U.S. Pat. No. 4,155,401, issued May 22, 1979.

SUMMARY OF THE INVENTION

The invention provides a method for removing a casting from a sandbox, the method comprising the steps of rotating a sandbox including therein a casting embedded in sand so as to dump the sand from the sandbox, holding the casting while the sand is being dumped so as to maintain a substantially stationary relationship between the casting and the sandbox, and removing the casting from the sandbox after a portion of the sand has been dumped.

The invention also provides a method for removing a casting from a sandbox, the method comprising the steps of clampingly engaging, with a robotic arm, a casting embedded in sand in a sandbox, rotating the robotic arm and the sandbox so as to dump the sand from the sandbox and so as to maintain a substantially stationary relationship between the casting and the sand box, and removing the casting from the sandbox, after a portion of the sand has been dumped, by effecting relative movement between the robotic arm and the sandbox.

In one embodiment, the method further comprises at least one of the following steps: inverting the casting with the robotic arm so as to remove trapped sand from the casting, and vibrating the casting with the robotic arm so as to remove trapped sand from the casting.

In one embodiment, the method further comprises the step of moving the robotic arm so as to place the casting in a quench tank to cool the casting.

The invention also provides an apparatus comprising a sandbox adapted to contain sand compacted around a casting, means for dumping the sand from the sandbox, and means for holding the casting while the sand is being dumped from the sandbox so as to maintain a substantially stationary relationship between the casting and the sandbox, and for removing the casting from the sandbox after a portion of the sand has been dumped from the sandbox.

In one embodiment, the means for holding and removing the casting includes a movable robotic arm adapted to clampingly engage the casting.

In one embodiment, the means for dumping the sand includes means for clampingly engaging the sandbox and rotating the sandbox about a horizontal axis.

In one embodiment, the means for holding and removing the casting includes a movable robotic arm adapted to clampingly engage the casting, the robotic arm being pivotable about the horizontal axis.

In one embodiment, the robotic arm has a first end including the means for clampingly engaging the casting, and a second end pivotable about the horizontal axis.

A principal feature of the invention is the provision of a method for removing a casting from a sandbox without fluidizing the compacted sand or losing the orientation of the casting.

Another principal feature of the invention is the provision of a method for removing a casting from a sandbox without distorting the casting.

Another principal feature of the invention is the provision of an apparatus for performing the method of the invention.

Other features and advantages of the invention will become apparent to those skilled in the art upon review of the following detailed descripion, claims, and drawings.

DESCRIPTION OF THE PREFERRED EMBODIMENT

Figure 7:
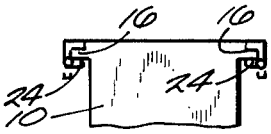
FIG. 7 is an end view taken along line 7—7 in FIG. 6.

Illustrated in the drawings is a sandbox 10 supported on a conveyor 12, such as in an automated casting line. The sandbox 10 contains sand compacted around a casting 14 that has a sprue extending upwardly therefrom. The sandbox 10 includes, along its upper edges, outwardly extending flanges 16, as best shown in FIG. 7, the reason for which will be explained later.

Figure 1:
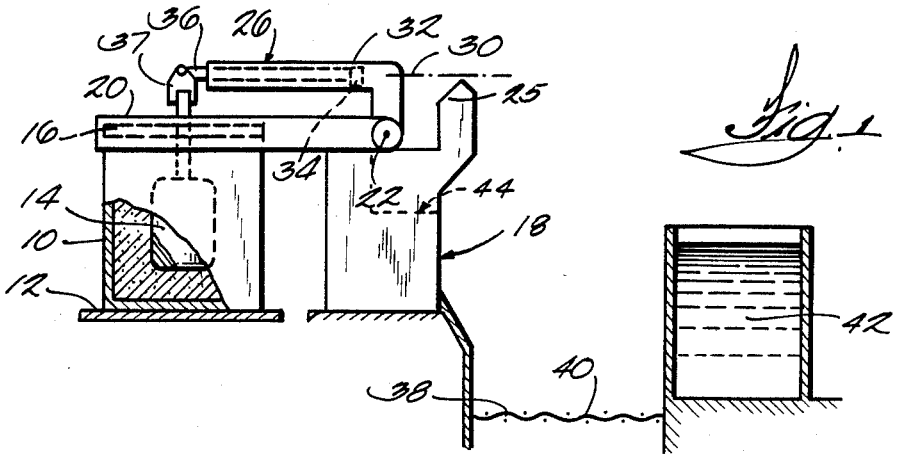
FIG. 1 is a side view of an embodiment of the apparatus of the invention.
Figure 6:
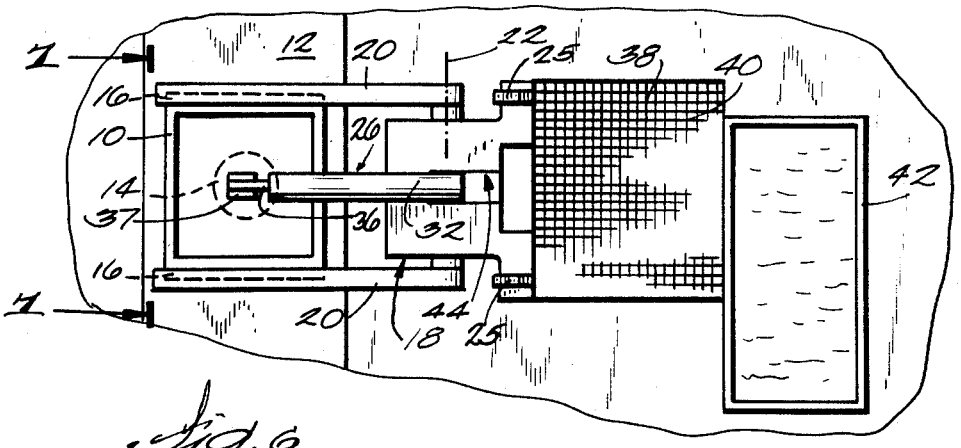
FIG. 6 is a top view of the apparatus of FIG. 1.

Also illustrated is means for dumping the sand from the sandbox 10. While various suitable means could be employed for this purpose, in the illustrated construction, the means includes an apparatus 18 having connected thereto and supporting a pair of generally parallel spaced apart arms 20 (see FIGS. 1 and 6). Each arm has an inside end pivotable about a common horizontal axis 22, and an outside end including means for clampingly engaging a flange 16 of the sandbox. As best shown in FIG. 7, in the preferred embodiment, the means for clampingly engaging a flange 16 of the sandbox includes hydraulic clamps 24. FIG. 1 shows the arms 20 in position for clampingly engaging the flanges 16 of the sandbox 10. The apparatus 18 includes a pair of stops 25, as best shown in FIGS. 1 and 6, for limiting rotation of the arms 20 for dumping sand, and power means (not shown) for selectively rotating the arms 20 about the horizontal axis 22. It should be noted that such a dumping device is conventional and need not be described in greater detail herein.

Also illustrated is means for holding the casting 14 while the sand is being dumped from the sandbox 10 so as to maintain a substantially stationary relationship between the casting 14 and the sandbox 10, and for removing the casting 14 from the sandbox 10 after a portion of the sand has been dumped from the sandbox 10. While various suitable means could be employed for this purpose, in the illustrated construction, the means includes a robotic arm 26.

A robotic arm has not, to the knowledge of the inventor, ever been used in the manner to be described hereinafter. However, the technology necessary for building such a robotic arm is well known, and anyone of ordinary skill in the robotics art could build such a robotic arm. Therefore, the working details of the robotic arm 26 will not be described. Only those details necessary for an understanding of the functioning of the robotic arm 26 will be described.

The robotic arm 26 is supported by the apparatus 18 and is connected to the apparatus 18 between the arms 20, as best shown in FIG. 6. The arm 26 is pivotale about the horizontal axis 22 independently of the arms 20 and is L-shaped, including an inside end pivotable about the horizontal axis 22, a main portion, and an outside end including means for clampingly engaging the sprue of the casting 14. In the preferred embodiment, the means for clampingly engaging the sprue is a conventional mechanical hand 37.

The main portion of the arm 26 has a longitudinal axis 30 and is longitudinally extendible and contractable. In the illustrated construction, shown in FIG. 5, the main portion comprises a hydraulic cylinder-piston assembly including a cylinder 32, a piston 34 slidably received in the cylinder 32, and a piston rod 36 having one end fixedly attached to the piston 34 and an opposite end extending outwardly of the cylinder 32. The piston rod 36 is rotatably about the longitudinal axis 30, and the opposite end of the piston rod 36 includes the means for clampingly engaging the sprue of the casting.

Figure 2:
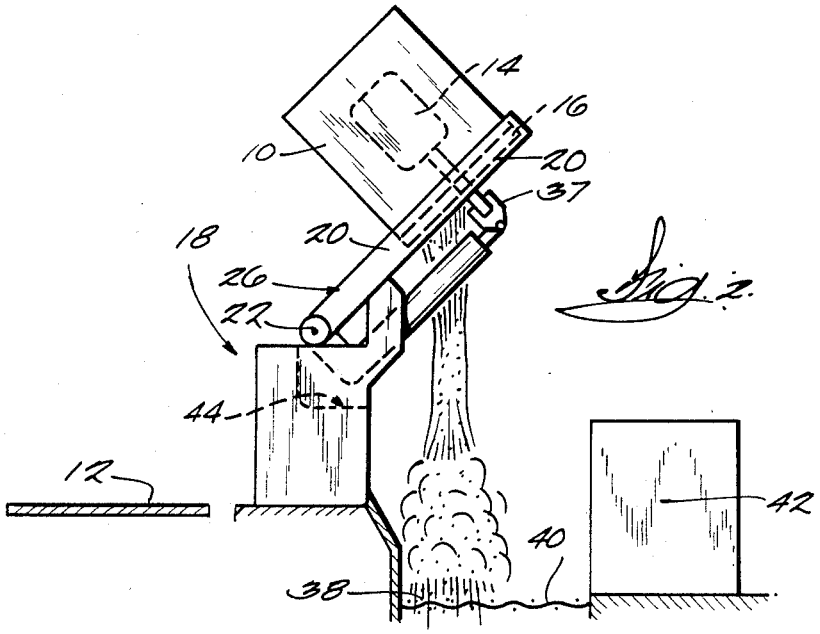
FIG. 2 is a side view of the apparatus shown in FIG. 1, showing sand being dumped from the sandbox.
Figure 4:
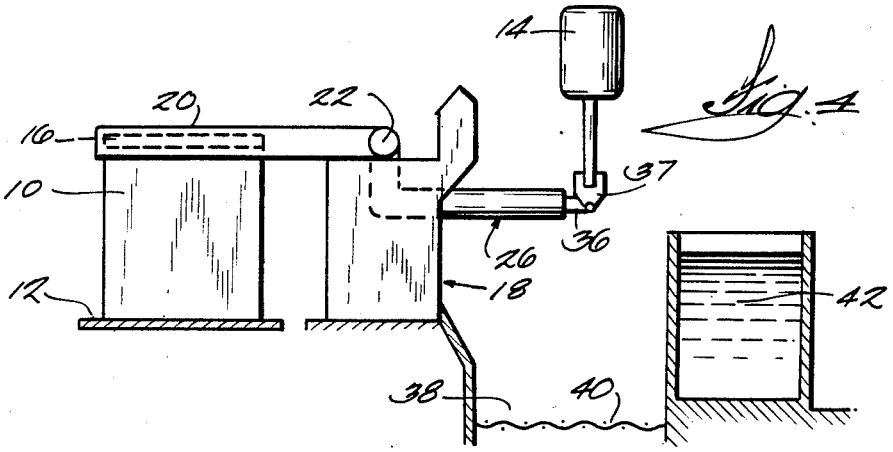
FIG. 4 is a side view showing the casting returned to the upwardly extending position.

As shown in FIGS. 1, 2, and 6, the apparatus 18 includes a recess 44 allowing the robotic arm 26 to rotate into the position shown in FIG. 4.

The apparatus 18 also includes means for selectively rotating the robotic arm 26 about the horizontal axis 22, means for selectively supplying hydraulic fluid to the cylinder 32 for extending and contracting the piston rod 36, means for selectively operating the mechanical hand 37, and means for selectively rotating the piston rod 36 about the longitudinal axis 30. Furthermore, the apparatus includes suitable control means for controlling the operation of the robotic arm 26 and the arms 20. These means are conventional and are not illustrated in the drawings.

Also shown is a pit 38 for receiving the sand dumped from the sandbox 10, and a screen 40 or sieve positioned above the pit 38 for removing contaminants from the sand. Further shown is a quench tank 42 containing, in the preferred embodiment, water for cooling the casting 14 after it has been removed from the sandbox 10.

In operation, the apparatus 18 functions as follows. The sandbox 10 is conveyed to the apparatus 18 by the conveyor 12. When the sandbox 10 is in position in front of the apparatus 18, the arms 20 are lowered so as to be adjacent the flanges 16 of the sandbox 10, as shown in FIG. 1, and the hydraulic clamps 24 engage the flanges 16, as shown in FIG. 7. Simultaneously, or immediately thereafter, the robotic arm 26 is lowered into the position shown in FIG. 1 so that the mechanical hand 37 is adjacent the sprue of the casting 14. The sprue is then engaged by the mechanical hand 37.

As shown in FIG. 2, the robotic arm 26 and the arms 20 are then simultaneously rotated about the horizontal axis 22, thereby maintaining a substantially stationary relationship between the casting 14 and the sandbox 10 while the sand is dumped from the sandbox 10.

The dumped sand passes through the screen 40 into the pit 38, for reuse, while contaminants in the sand remain on top of the screen 40 for removal. If desired, a cover could be placed over the quench tank 42 during the dumping of the sand in order to prevent sand from entering the quench tank 42.

When at least enough of the sand has been dumped from the sandbox 10 so that the casting 14 is no longer surrounded by sand, the arms 20 are rotated so that the sandbox 10 is returned to the conveyor 12. At the same time, the robotic arm 26 is maintained in the position shown in FIG. 2 so that the casting 14 is removed from the sandbox 10. This step is shown in FIG. 3 (the arm 26 is shown in phantom).

Figure 3:
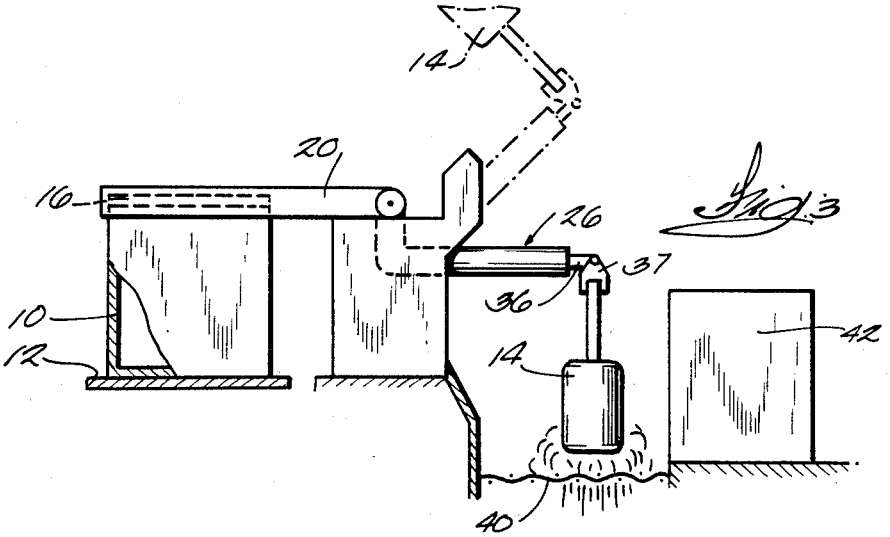
FIG. 3 is a side view of the apparatus showing the sandbox being returned to the converyor, and showing the casting being inverted.

Next, the arm 26 is lowered and the casting 14 is inverted by rotating the piston rod 36 180° about the longitudinal axis 30, as shown in solid lines in FIG. 3. The purpose of this is to remove any remaining sand trapped in or on the casting 14. In alternative embodiments, the casting 14 could be either vibrated or vibrated and inverted to remove trapped sand from the casting 14.

Next, the casting 14 is returned to the upwardly extended position, as shown in FIG. 4, by again rotating the piston rod 36 180°.

Figure 5:
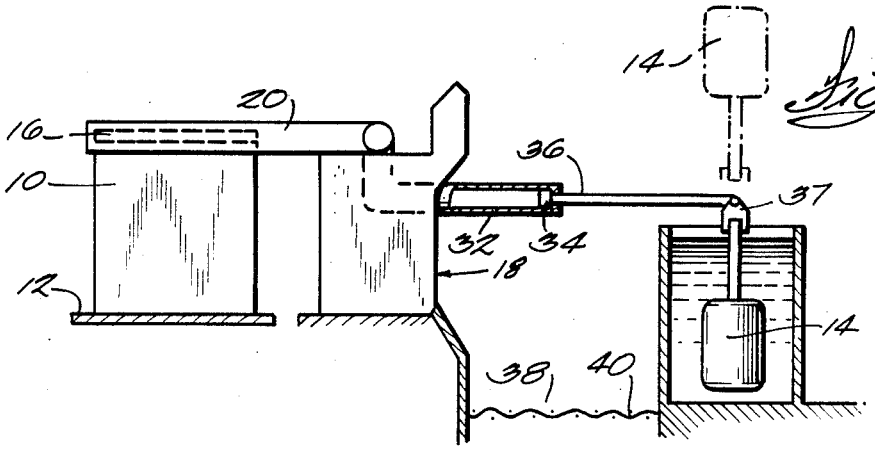
FIG. 5 is a side view of the apparatus showing the casting being inserted in the quench tank.

Next, the robotic arm 26 is extended as shown in phantom in FIG. 5 so that the casting 14 is in position to be lowered into the quench tank 42.

Finally, the casting 14 is again inverted so as to place the casting 14 in the quench tank 42, as shown in solid lines in FIG. 5.

After the casting 14 is placed in the quench tank 42, further operations can be performed on the casting 14 with automatic equipment. For example, the casting 14 can be released by the robotic arm 26 and engaged by another robotic arm for moving the casting 14 to a degating fixture or for orienting the casting 14 for degating.

Various features of the invention are set forth in the following claims.

I claim:

1. A method for removing a casting from a sandbox, the method comprising the steps of rotating a sandbox including therein a casting embedded in sand so as to dump the sand from the sandbox, holding the casting while the sand is being dumped so as to maintain a substantially stationary relationship between the casting and the sandbox, and removing the casting from the sandbox after a portion of the sand has been dumped.

2. A method for removing a casting from a sandbox, said method comprising the steps of clampingly engaging, with a robotic arm, a casting embedded in sand in a sandbox, rotating the robotic arm and the sandbox so as to dump the sand from the sandbox and so as to maintain a substantially stationary relationship between the casting and the sand box, and removing the casting from the sandbox, after a portion of the sand has been dumped, by effecting relative movement between the robotic arm and the sandbox.

3. A method in accordance with claim 2 and further comprising at least one of the following steps: inverting the casting with the robotic arm so as to remove trapped sand from the casting, and vibrating the casting with the robotic arm so as to remove trapped sand from the casting.

4. A method in accordance with claim 3 and further comprising the step of moving the robotic arm so as to place the casting in a quench tank to cool the casting.

5. A casting apparatus comprising a sandbox adapted to contain sand compacted around a casting, means for dumping the sand from said sandbox, and means for holding the casting while the sand is being dumped from said sandbox so as to maintain a substantially stationary relationship between the casting and said sandbox, and for removing the casting from said sandbox after a portion of the sand has been dumped from said sandbox.

6. An apparatus as set forth in claim 5 wherein said means for holding and removing the casting includes a movable robotic arm adapted to clampingly engage the casting.

7. An apparatus as set forth in claim 5 wherein said means for dumping the sand includes means for clampingly engaging said sandbox and rotating said sandbox about a horizontal axis.

8. An apparatus as set forth in claim 7 wherein said means for holding and removing the casting includes a movable robotic arm adapted to clampingly engage the casting, said robotic arm being pivotable about said horizontal axis.

9. An apparatus as set forth in claim 8 wherein said robotic arm has a first end including means for claimpingly engaging the casting, and a second end pivotable about said horizontal axis.

* * * * *